US006364742B1

(12) United States Patent
Fukuzawa

(10) Patent No.: US 6,364,742 B1
(45) Date of Patent: Apr. 2, 2002

(54) CHEMICAL-MECHANICAL POLISHING APPARATUS

(75) Inventor: Hiroaki Fukuzawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/419,429

(22) Filed: Oct. 15, 1999

(30) Foreign Application Priority Data

Oct. 15, 1998 (JP) ..... 10-293441

(51) Int. Cl.[7] ..... B24B 49/00; B24B 51/00
(52) U.S. Cl. ..... 451/5; 451/41; 451/21
(58) Field of Search ..... 451/5, 6, 8, 9, 451/10, 41, 285, 287, 288, 56, 21

(56) References Cited

U.S. PATENT DOCUMENTS 5,618,221 A * 4/1997 Furukawa et al. ..... 451/443
5,655,951 A * 8/1997 Meikle et al. ..... 451/444
5,664,987 A 9/1997 Renteln
5,975,994 A * 11/1999 Sandhu et al. ..... 451/444

FOREIGN PATENT DOCUMENTS

| | | |
|---|---|---|
| EP | 0 829 327 A1 | 3/1998 |
| JP | 9-285955 | 11/1997 |
| JP | 10-15807 | 1/1998 |
| JP | 100015807 | 1/1998 |
| JP | 110138418 A | 5/1999 |

* cited by examiner

*Primary Examiner*—Derris H. Banks
(74) *Attorney, Agent, or Firm*—Hutchins, Wheeler & Dittmar

(57) ABSTRACT

A chemical-mechanical polishing apparatus includes a polishing pad, a polishing table, a wafer holder, a dresser for setting the polishing pad each time after a specified number of wafers are chemically and mechanically polished; and a conditioning controller for controlling the conditions of setting the polishing pad based on a polishing rate and a required length of polishing time. The chemical-mechanical polishing apparatus can suitably correct, after every polishing of the specified number of wafers, the setting conditions of the polishing pad and can properly conduct the subsequent polishing.

10 Claims, 7 Drawing Sheets

FIG. 4

CONVERSION TABLES ARE SELECTED FROM DATA BASE BASED ON KIND OF FILM AND PRODUCT NAME

KIND OF FILM:OXIDE FILM 1,PRODUCT NAME:12345

| CURRENT POLISHING RATE | | | | | |
|---|---|---|---|---|---|
| 1600 | 80 | 75 | 70 | 65 | 60 |
| 1500 | 85 | 80 | 75 | 70 | 65 |
| 1400 | 90 | 85 | 80 | 75 | 70 |
| 1300 | 95 | 90 | 85 | 80 | 75 |
| 1200 | 100 | 95 | 90 | 85 | 80 |
| 1100 | 105 | 100 | 95 | 90 | 85 |
| 1000 | 110 | 105 | 100 | 95 | 90 |
| | -100 | -50 | 0 | 50 | 100 |

POLISHING RATE VARIATION AMOUNT

LENGTH OF CONDITIONING TIME IS CALCULATED BASED ON CURRENT POLISHING RATE AND POLISHING RATE VARIATION AMOUNT

EXAMPLE:

WHEN
CURRENT POLISHING RATE X=1250
POLISHING RATE VARIATION RATE R=45,
CALCULATION IS CONDUCTED BY EMPLOYING THE BELOW PART OF THE CONVERSION TABLE BECAUSE
$1200 \leqq X \leqq 1300$ AND $0 \leqq R \leqq 50$.

| | | |
|---|---|---|
| X1=1300 | T1=85 | T3=80 |
| X2=1200 | T2=90 | T4=85 |
| | RA=0 | RB=50 |

LENGTH OF CONDITIONING TIME IS CALCULATED BASED ON:

$TA = ((T2-T1) / (X2-X1)) \times (X-X1) + T1$ $TB = ((T4-T3) / (X2-X1)) \times (X-X1) + T3$ $T = ((TB-TA) / (RB-RA)) \times (R-RA) + TA$

AND IS ESMITATED T=83

FIG. 7

CHARACTERISTICS SUCH AS VARIATION AMOUNT AND INTEGRATION AMOUNT ARE EXTRACTED FROM CURRENT VALUES SUPPLIED TO TABLE MOTOR AND SPINDLE MOTOR

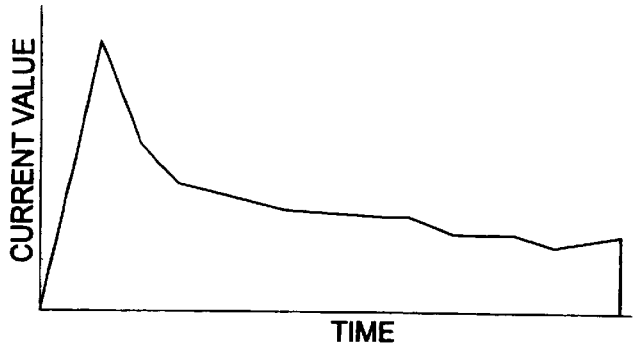

CONVERSION TABLES ARE SELECTED FROM DATA BASE BASED ON KIND OF FILM AND PRODUCT NAME

KIND OF FILM:OXIDE FILM 1,PRODUCT NAME:12345

| CURRENT INTEGRATION VALUE | | | | | |
|---|---|---|---|---|---|
| 1600 | 80 | 75 | 70 | 65 | 60 |
| 1500 | 85 | 80 | 75 | 70 | 65 |
| 1400 | 90 | 85 | 80 | 75 | 70 |
| 1300 | 95 | 90 | 85 | 80 | 75 |
| 1200 | 100 | 95 | 90 | 85 | 80 |
| 1100 | 105 | 100 | 95 | 90 | 85 |
| 1000 | 110 | 105 | 100 | 95 | 90 |
| | -100 | −50 | 0 | 50 | 100 |

POLISHING RATE VARIATION AMOUNT

LENGTH OF CONDITIONING TIME IS CALCULATED BASED ON CURRENT POLISHING RATE AND POLISHING RATE VARIATION AMOUNT

EXAMPLE:

WHEN
CURRENT POLISHING RATE X=1250
POLISHING RATE VARIATION RATE R=45,
CALCULATION IS CONDUCTED BY EMPLOYING THE BELOW PART OF THE CONVERSION TABLE BECAUSE
$1200 \leqq X \leqq 1300$ AND $0 \leqq R \leqq 50$.

| | | |
|---|---|---|
| X1=1300 | T1=85 | T3=80 |
| X2=1200 | T2=90 | T4=85 |
| | RA=0 | RB=50 |

LENGTH OF CONDITIONING TIME IS CALCULATED BASED ON:

$TA = ((T2-T1) / (X2-X1)) \times (X-X1) + T1$ $TB = ((T4-T3) / (X2-X1)) \times (X-X1) + T3$ $T = ((TB-TA) / (RB-RA)) \times (R-RA) + TA$

AND IS ESMITATED T=83

CHEMICAL-MECHANICAL POLISHING APPARATUS

BACKGROUND OF THE INVENTION (a) Field of the Invention

The present invention relates to a chemical-mechanical polishing apparatus, more in detail to the chemical-mechanical polishing apparatus which can perform polishing a wafer at a stabilized amount by sufficiently controlling the polished amount of the wafer.

(b) Description of the Related Art

In manufacture of a semiconductor device, a wafer is polished by employing a chemical-mechanical polishing apparatus (hereinafter referred to as "CMP apparatus"). It is important to keep the polished amount in a fixed range when the polishing is conducted by employing the CMP apparatus. The CMP apparatus generally has a controller for controlling the length of polishing time.

An example of a conventional CMP apparatus will be described referring to FIG. 1.

The conventional CMP apparatus 10 has a polishing block 12 for polishing a film formed on a wafer and a controller 14 for controlling the length of polishing time.

The polishing block 12 includes a polishing treatment section 15 for polishing the film on the wafer, a thickness meter 16 for measuring film thicknesses before and after the polishing and a conditioning treatment section 18 having a dresser for setting a polishing pad. The polishing treatment section 15 includes the polishing pad (not shown), a polishing table (not shown) which rotates while holding the polishing pad, a wafer holder (not shown) which rotates the film while pressing the film on the wafers to the polishing pad, and a time section (not shown) for measuring a length of polishing time.

The controller 14 includes a thickness data input section 21 for receiving film thickness data transmitted from the polishing block 12, a rate calculation section 22 for calculating a polishing rate from the film thicknesses before and after the polishing and the length of the polishing time, a time calculation section 23 for calculating the length of polishing time for the next wafer, and an output section 24 for transmitting the calculated length of polishing time to the polishing block 12.

In order to polish the film on the wafer by employing the conventional CMP apparatus 10, at first, the film thickness before the polishing is measured by the thickness meter 16 for measuring the film thicknesses, and the data obtained by this measurement (hereinafter referred to as "pre-polishing thickness data") is sent to the controller 14.

Then, a polishing treatment is performed. The CMP apparatus 10 conducts a setting treatment upon the completion of the polishing.

Further, the film thickness after the polishing is measured by employing the thickness meter 16, and the data obtained by this measurement (hereinafter referred to as "post-polishing thickness data") is sent to the controller 14. The controller 14 calculates a current polished amount based on the pre-polishing thickness data and the post-polishing thickness data, and also calculates the length of time required for the polishing treatment of the next wafer, and the length of time thus obtained is sent to the polishing block 12.

However, in the conventional CMP apparatus, the length of the polishing time is always varied because the conditions for setting the polishing pad are not constant. The required length of the polishing time for a single wafer increases with every wafer polishing and the length of the polishing time is considerably reduced immediately after the setting of the polishing pad. Therefore, disadvantages have been recognized such that the polished amount of the wafer cannot be sufficiently controlled and the polishing pad is liable to be damaged and has a reduced life.

SUMMARY OF THE INVENTION

In view of the foregoing, an object of the present invention is to provide a CMP apparatus which sufficiently controls a polished amount of a wafer and conducts a stable polishing treatment.

The present invention provides a CMP apparatus comprising: a polishing pad; a polishing table rotatable while holding said polishing pad; a wafer holder which presses a film on a wafer to said polishing pad while holding the wafer; a dresser for setting said polishing pad each time after a specified number of said wafers are chemically and mechanically polished; and a conditioning controller including a rate calculation section for calculating a polishing rate and an establishing section for establishing conditions for setting said polishing pad based on the calculated polishing rate.

In accordance with the CMP apparatus of the present invention, after polishing of the specified number of the wafers, the setting conditions of the polishing pad can be suitably corrected or the conditions of the polishing pad can be maintained nearly constant, and the polishing can be properly conducted. Accordingly, the CMP apparatus can be provided in which the polishing rate is stabilized and the polished amount is sufficiently controlled. Further, the damages generated on the polishing pad are much smaller than those of the prior art. In the present invention, it is preferable that the specified number of wafers be generally 1 or 2.

The above and other objects, features and advantages of the present invention will be more apparent from the following description.

BRIEF DESCRIPTION OF DRAWINGS

FIG. 4 is a diagram showing a treatment process in Example of Embodiment 1.

FIG. 7 is a diagram showing a treatment process in Example of Embodiment 2.

PREFERRED EMBODIMENTS OF THE INVENTION

Now, the present invention is more specifically described with reference to accompanying drawings.

Embodiment 1

Figure 1:
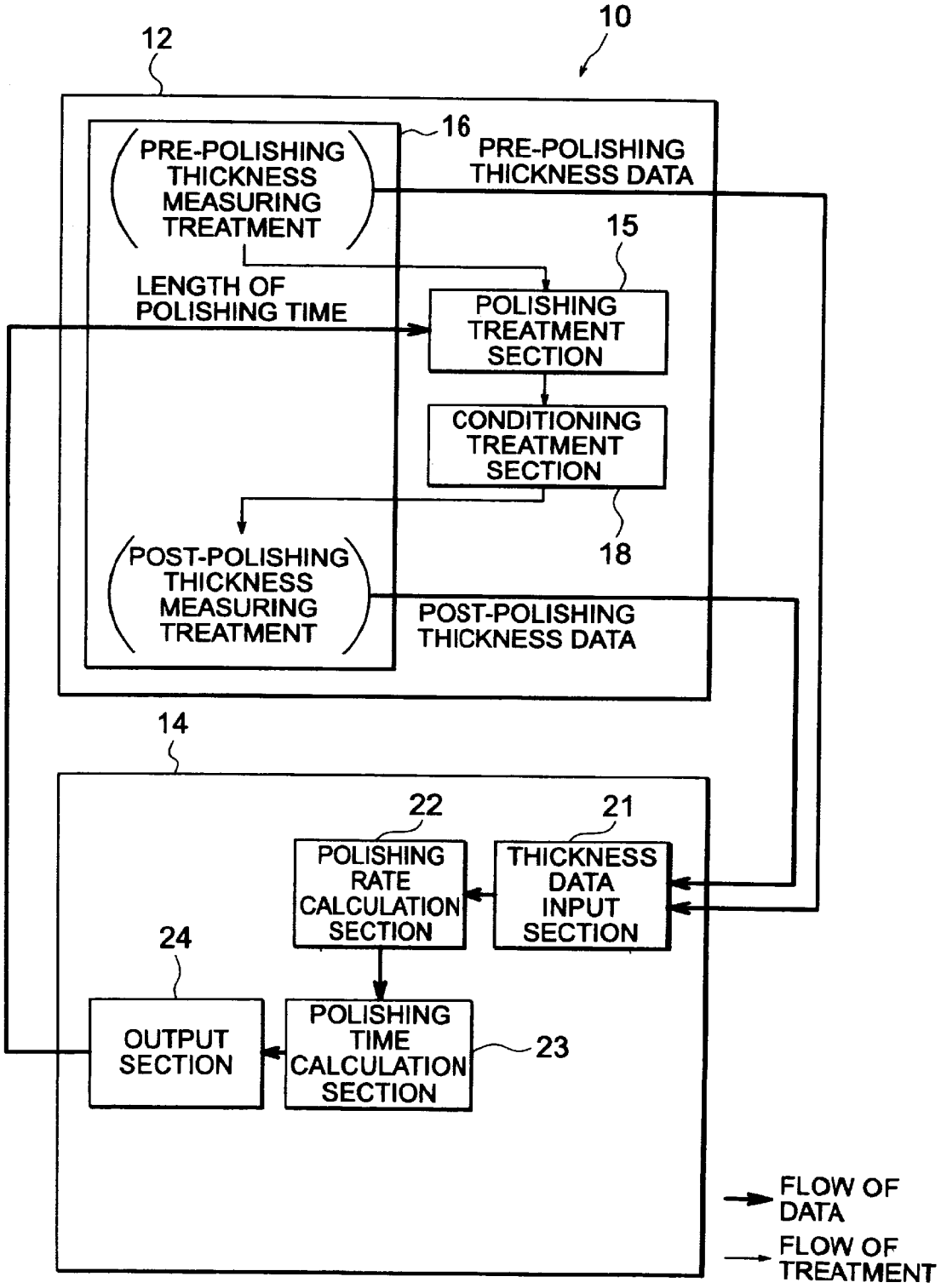
FIG. 1 PRIOR ART
FIG. 1 is a block diagram showing a configuration of a conventional CMP apparatus and a treatment process conducted thereby.
Figure 2:
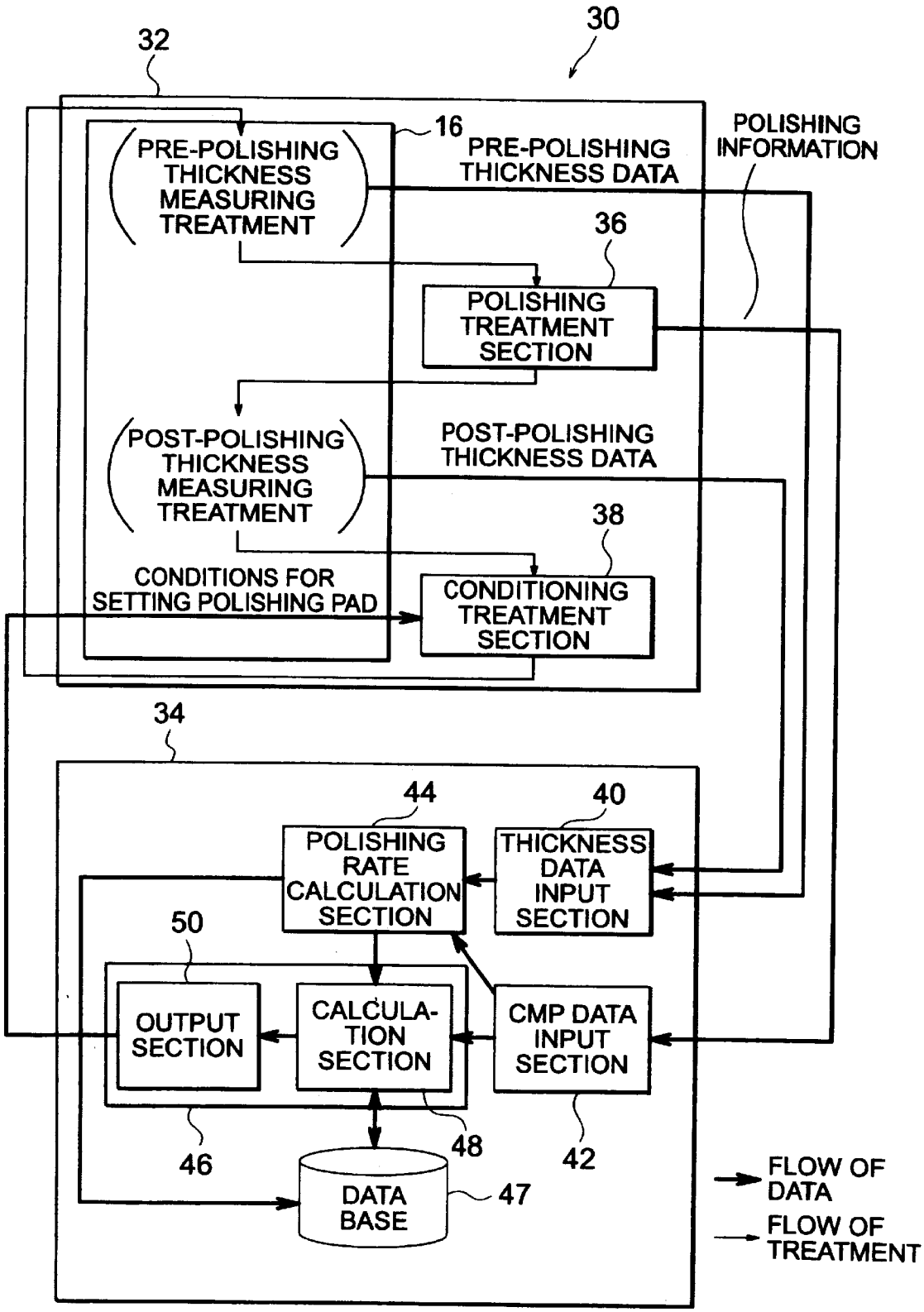
FIG. 2 is a block diagram showing a configuration of a CMP apparatus of Embodiment 1 and a treatment process conducted thereby.

In FIG. 2 showing an Embodiment of a CMP apparatus and a flow of treatments by employing the CMP apparatus, similar elements to those described in relation to the prior art of FIG. 1 are denoted by the same reference numerals and their detailed description will be omitted.

A CMP apparatus 30 in FIG. 2 has a polishing lock 32 and a conditioning controller 34 for establishing setting conditions of a polishing pad, and the conditioning controller 34 is connected to the polishing block 32 by means of a signal line for supplying and receiving signals.

The polishing block 32 includes a treatment section 36 for polishing a film on a wafer, a thickness meter 16 for measuring film thicknesses before and after the polishing and a conditioning treatment section 38 having a dresser for setting a polishing pad. The treatment section 36 includes the polishing pad (not shown), a polishing table (not shown), a wafer holder (not shown), and a timer section (not shown) for measuring a length of polishing time.

The conditioning controller 34 includes a thickness data input section 40 for receiving film thickness data from the thickness meter 16 and a CMP data input section 42 for receiving polishing information such as the length of polishing time as a polishing instruction from the polishing block 32.

The conditioning controller 34 further includes a calculation section 44 for calculating a polishing rate based on the data received from the both input sections 40 and 42, an establishing section 46 for establishing conditions for setting the polishing pad based on the calculated polishing rate, and a data base 47 for storing data. The establishing section 46 includes a calculation section 48 for calculating the required length of the setting time based on the polishing rate and the polishing information, and an output section 50 for transmitting the calculated length of the setting time to the conditioning treatment section 38. The data base 47 includes conversion tables for calculation of the required setting time for each of combinations of kinds of films and products, and the calculation section 48 conducts transfer of the data between the same and the data base 47.

Then, a process of polishing conducted by employing the CMP apparatus 30 will be described.

The pre-polishing thickness data of the film on the wafer to be subjected to the CMP treatment is measured by the thickness meter 16, and transmitted to the thickness data input section 40.

Then, the wafer is sent to the polishing block 32 and receives the polishing treatment therefrom. During the treatment, polishing information (the length of polishing time and the degree of pressing a spindle) and product information (the kind of films and the product name of the semiconductor device) are transmitted to the CMP data input section 42.

The wafer, upon the completion of the polishing treatment, is sent to the thickness meter 16 where the film thickness after the polishing is measured. The post-polishing thickness data is transmitted to the thickness data input section 40.

Thereafter, the calculation section 44 calculates the current polishing rate based on the pre-polishing thickness data and the post-polishing thickness data received by the thickness data input section 40 and the length of the polishing time received by the CMP data input section 42.

Figure 3:
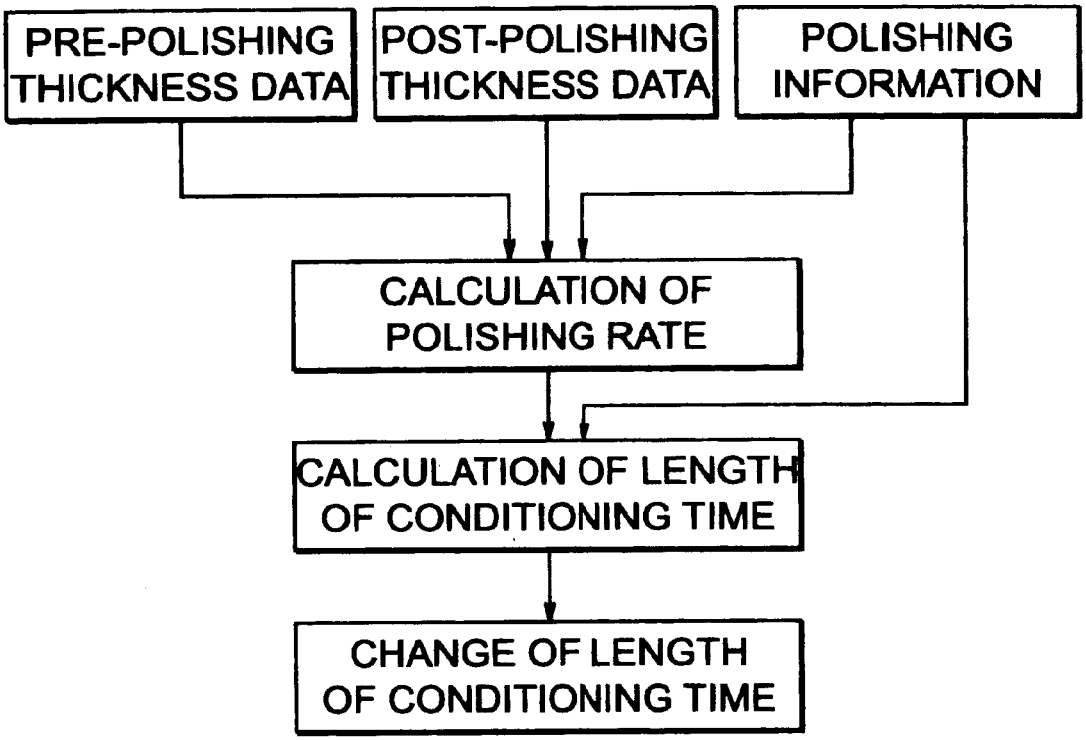
FIG. 3 is a block diagram showing a treatment process in Embodiment 1.

The calculation section 48 calculates a polishing rate variation value which is a difference between the current polishing rate and the previous polishing rate, and calculates a required length of setting time based on the current polishing rate, the polishing rate variation value and the conditioning time conversion data tables of the data base 47 (refer to FIG. 3).

The calculation of the required length of the setting time can be conducted as follows.

The calculation section 48 extracts required portions from the data base 47 including the data stored in the conversion data tables in relation to the product information, that is, to the kind of the film in connection with the wafer being treated and the product name of the semiconductor. The required length of the setting time is calculated by means of interpolation based on the extracted portions from the conversion data tables, the current polishing rate and the polishing rate variation value.

The output section 50 transmits the calculated length of the setting time to the polishing block 32 which conducts a setting treatment based on the received length of the setting time.

The calculated data and the data received from the Polishing block 32 are stored in the data base 47.

In the present Embodiment, the setting conditions of the polishing pad can be maintained nearly constant, and a polished amount of the film on the wafer is nearly constant and can be much more stabilized compared with that of the prior art. Further, the damages generated on the polishing pad are much smaller than those of the prior art.

A similar effect can be obtained by similarly calculating the pressing conditions of the conditioning head at the calculation section 48 and modifying the setting conditions in accordance with the calculated pressing conditions.

Example of Embodiment 1

In the present Example of which a treatment is illustrated in FIG. 4, the calculation section 48 calculates a required length of setting time by employing the following equations.

$$TA=\{(X-X1)/(X2-X1)\times(T2-T1)+T1 \quad (1)$$

$$TB=\{(X-X1)/(X2-X1)\times(T4-T3)+T3 \quad (2)$$

$$T=\{(R-RA)/(RB-RA)\times(TB-TA)+TA \quad (3)$$

In these equations, X is a current polishing rate, X1 and X2 are an upper limit and a lower limit of a range in which X can exist, respectively, among the polishing rates included in a setting time calculation table. R is a polishing rate variation value, RA and RB are an upper value and a lower limit of a range in which R can exist, respectively, among the polishing rate variation values included on the setting time calculation table. T1, T2, T3 and T4 are required lengths of setting times corresponding to X1 and RA, X2 and RA, X1 and RB, and X2 and RB, respectively.

In Embodiment 1, the calculated polishing rate X was 1250, and the polishing rate variation amount R was 45. Based on these values, X1=1300, X2=1200, T1=85, T2=90, T3=80, T4=85, RA=0 and RB=50 were obtained to calculate a required length of setting time T=83.

Embodiment 2

Figure 5:
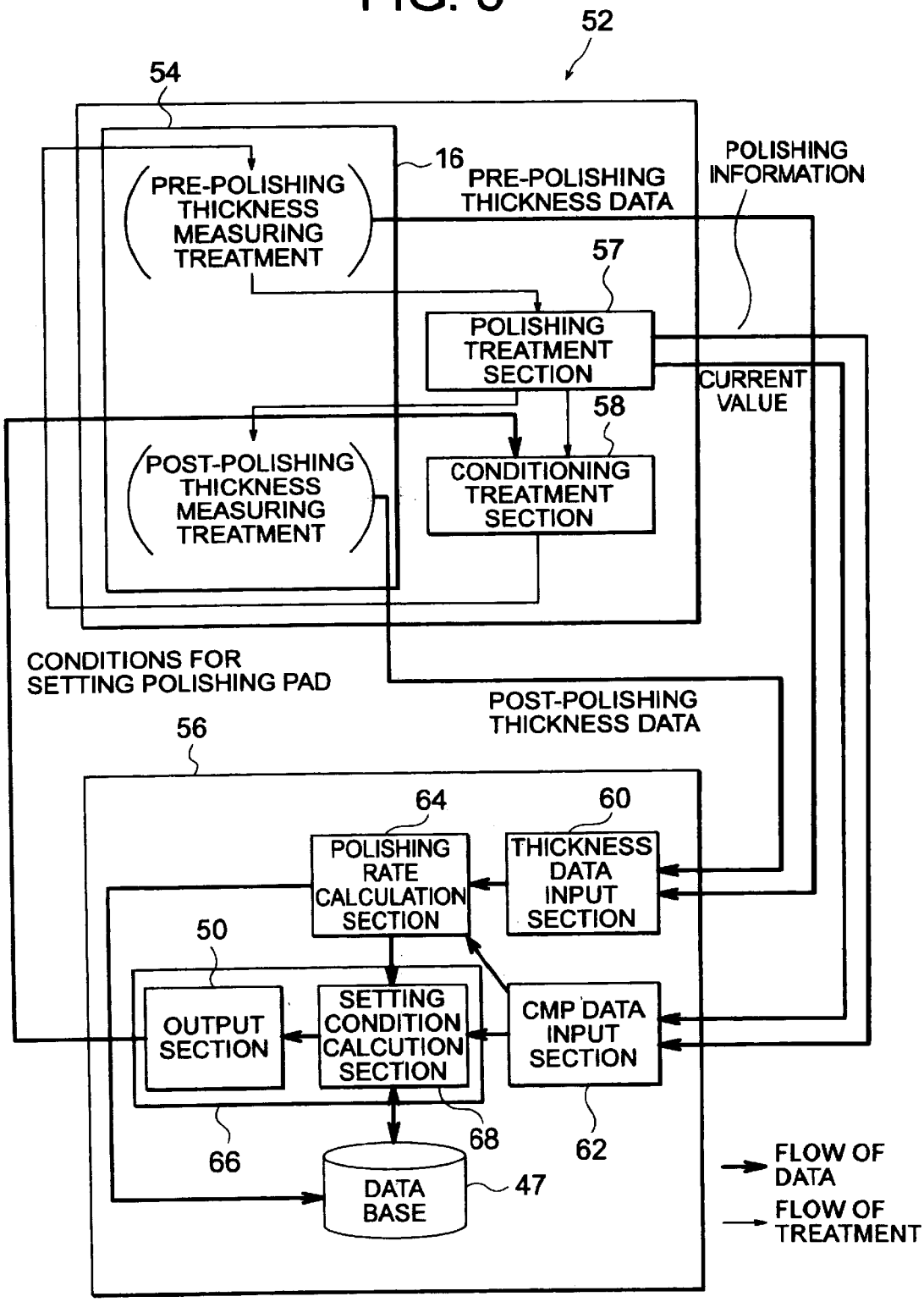
FIG. 5 is a block diagram showing a configuration of a CMP apparatus of Embodiment 2 and a treatment process conducted thereby.

A CMP apparatus 52 of Embodiment 2 shown in FIG. 5 is different from the CMP apparatus 30 of Embodiment 1 in that after the polishing of the wafer, the film thickness measurement and the setting of the polishing pad are simultaneously conducted. In Embodiment 2, similar elements to those of Embodiment 1 are denoted by the same reference numerals and their detailed description will be omitted.

The CMP apparatus 52 includes a polishing block 54 which polishes a film on a wafer, and a conditioning roller 56 for establishing setting conditions of a polishing pad, and the conditioning controller 56 is connected to the polishing block 54 by means of a signal line for supplying and receiving signals.

The polishing block 54 includes, similar to the polishing block 32 of Embodiment 1, a polishing treatment section 57 for polishing the film on the wafer, the thickness meter 16 for measuring film thicknesses before and after the polishing and a conditioning treatment section 58 having a dresser for setting the polishing pad. The polishing treatment section 57 includes the polishing pad (not shown), a polishing table (not shown), a wafer holder (not shown), and a device for measuring a length of polishing time (not shown). The Polishing block 54 further includes a table motor for rotating the polishing table and a spindle motor for rotating the wafer holder (both are not shown).

The conditioning controller 56 includes, similar to the conditioning controller 14, a thickness data input section 60 and a CMP data input section 62.

The conditioning controller 56 further includes a calculation section 64 which calculates a polishing rate from film thicknesses before and after polishing and a length of polishing time and calculates the polishing rate based on polishing information received from the Polishing block 54 during the polishing, an establishment section 66 for establishing the setting conditions of the polishing pad based on the calculated polishing rate and a data base 47 for storing the data. The calculation section 64 calculates the polishing rate based on current values supplied to the table motor and the spindle motor and the length of the polishing time. The establishment section 66 includes a setting conditions calculation section 68 for calculating a required length of setting time based on the polishing rate and a polishing instruction, and an output section 50 for transmitting the required length of the setting time to the conditioning treatment section 58. The data base 47 includes conditioning time conversion tables similar to those of Embodiment 1, and the setting conditions calculation section 68 conducts transfer of the data with the data base 47.

Figure 6:
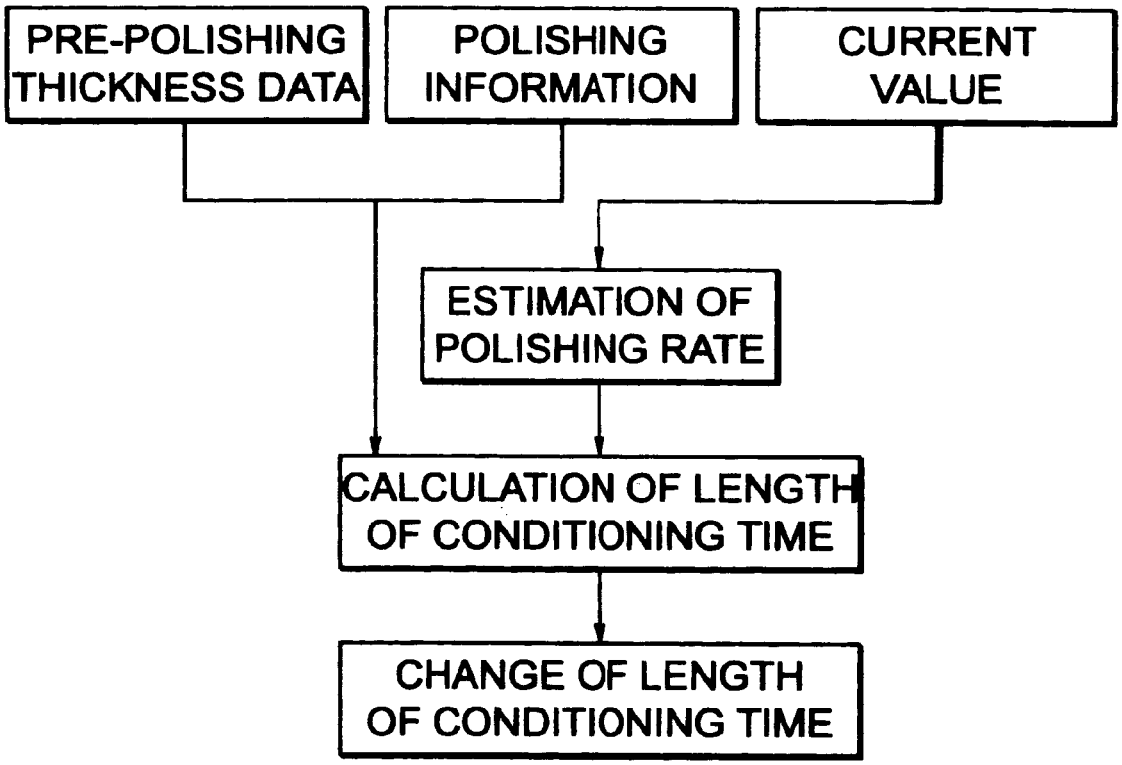
FIG. 6 is a block diagram showing a treatment process in Embodiment 2.

Then, a process of polishing conducted by employing the CMP apparatus 30 will be described referring to FIG. 6.

The pre-polishing thickness data of the film on the wafer subjected to the CMP treatment are measured with the thickness meter 16, and transmitted to the film thickness data input section 60.

Then, the wafer is sent to the Polishing block 54 and receives the polishing treatment. During the treatment, polishing information (a length of polishing time and a degree of pressing a spindle), current values supplied to a table motor and a spindle motor and product information (a kind of films and a product name of a semiconductor device) are transmitted to the CMP data input section 62.

The wafer upon the completion of the polishing treatment is sent to the thickness meter 16 and the film thickness after the polishing is measured. The post-polishing thickness data is transmitted to the film thickness data input section 60.

Simultaneously therewith, the polishing rate calculation section 64 calculates the current polishing rate based on the current values of the table motor and the spindle motor and the length of the polishing time, and estimates the conditions of the polishing pad.

The conditioning time conversion data tables is fitted to the kind of the film currently treated and the product name of the semiconductor are extracted from the data base 47 and received.

Thereafter, a required length of setting time is calculated and transmitted to a conditioning treatment section 58 similar to Embodiment 1.

Upon the completion of the measurement of the film thickness after the polishing, the polishing rate calculation section 64 calculates a precise value of the current polishing rate based on the pre-polishing thickness data and the post-polishing thickness data received by the film thickness data input section 60 and the length of the polishing time received by the CMP data input section 62, and stores the precise data in the data base 47, and the precise data is employed as data for improving the accuracy of a subsequent setting treatment.

Similar effects to those of Embodiment 1 can be obtained in Embodiment 2. The polished amount can be sufficiently controlled even if the CMP apparatus 52 does not have the thickness meter 16.

Example of Embodiment 2

In this Example, a graph showing a relation between a length of polishing time and current values of a table motor and a spindle motor was made, and a polishing rate was calculated based on the graph and in accordance with a procedure shown in FIG. 7. The calculated polishing rate X was 1250, and a variation amount R of the polishing rate was 45. Based on these values, X1=1300, X2=1200, T1=85, T2=90, T3=80, T4=85, RA=0 and RB=50 were obtained, similar to Embodiment 1, to calculate a required length of setting time T=83.

Thereafter, a precise value of the polishing rate was calculated based on the pre-polishing thickness data and the post-polishing thickness data and was stored in the data base 47.

Since the above embodiments are described only for examples, the present invention is not limited to the above embodiments and various modifications or alternations can be easily made therefrom by those skilled in the art without departing from the scope of the present invention.

What is claimed is:

1. A chemical-mechanical polishing (CMP) apparatus comprising:

a polishing pad;

a polishing table rotatable while holding said polishing pad;

a wafer holder which presses a film on a wafer to said polishing pad while holding the wafer;

a dresser providing a position and condition of said polishing pad each time after a specified number of said wafers are chemically and mechanically polished; and a conditioning controller performing at least a rate calculation for calculating a polishing rate based upon an output from at least one of a thickness meter measuring the wafer, a spindle pressure meter and a power meter, and a calculation for establishing polishing conditions of said polishing pad based on the calculated polishing rate.

2. A chemical-mechanical polishing (CMP) apparatus comprising:

a polishing pad;

a polishing table rotatable while holding said polishing pad;

a wafer holder which presses a film on a wafer to said polishing pad while holding the wafer;

a dresser providing a position and condition of said polishing pad after a specified number of said wafers are chemically and mechanically polished; and a conditioning controller performing at least a rate calculation for calculating a polishing rate and establishing conditions for at least a position and pressure of said polishing pad based on the calculated polishing rate;

wherein said rate calculation calculates the polishing rate based on film thickness before and after polishing of the film and a length of the polishing time.

3. The CMP apparatus as defined in claim 2, wherein said conditioning controller establishes a required length of polishing time in accordance with a correlation between the polishing rate and a required pressing force of a dresser to said polishing pad.

4. The CMP apparatus as defined in claim 3, wherein the correlation between the polishing rate and a required pressing force of a dresser to said polishing pad is specified by a graph.

5. The CMP apparatus as defined in claim 3, wherein the correlation between the polishing rate and a required pressing force of a dresser to said polishing pad is specified by a table.

6. The CMP apparatus as defined in claim 2, wherein said conditioning controller establishes a required pressing force of a dresser to said polishing pad in accordance with a correlation between the polishing rate and a required length of the polishing time.

7. The CMP apparatus as defined in claim 6, wherein the correlation between the polishing rate and a required length of the polishing setting time is specified by a graph.

8. The CMP apparatus as defined in claim 6, wherein the correlation between the polishing rate and a required length of the polishing time is specified by a table.

9. The CMP apparatus as defined in claim 6, wherein said conditioning controller establishes the conditions by interpolation of the correlation specified by a table.

10. A chemical-mechanical polishing (CMP) apparatus comprising:

a polishing pad;

a polishing table rotatable while holding said polishing pad;

a wafer holder which presses a film on a wafer to said polishing pad while holding the wafer;

a dresser providing a position and condition of said polishing pad each time after a specified number of said wafers are chemically and mechanically polished; and a conditioning controller performing at least a rate calculation for calculating a polishing rate and establishing conditions for at least a position and pressure of said polishing pad based on the calculated polishing rate;

wherein said rate calculation calculates the polishing rate based on film thickness before and after polishing of the film and a length of the polishing time, wherein said polishing rate calculation calculates a polishing rate based on current power required for rotating the polishing table and the wafer holder during the polishing and calculates a length of polishing time for the wafer based on film thickness before and after polishing of at least one previous wafer.

* * * * *